US012590411B2

(12) United States Patent
Chen et al.

(10) Patent No.: US 12,590,411 B2
(45) Date of Patent: Mar. 31, 2026

(54) PAPER PULP, A METHOD FOR PRODUCING PAPER PULP, AND PAPER PULP PRODUCTS

(71) Applicant: ShenZhen YUTO Packaging Technology Co., Ltd., Shenzhen (CN)

(72) Inventors: Zhangyan Chen, Shenzhen (CN); Guocheng Han, Shenzhen (CN); Rui Guo, Shenzhen (CN); Mengyao Li, Shenzhen (CN); Yinglong Wang, Shenzhen (CN); Yanfei Cheng, Shenzhen (CN)

(73) Assignee: ShenZhen YUTO Packaging Technology Co., Ltd., Shenzhen (CN)

( * ) Notice: Subject to any disclaimer, the term of this patent is extended or adjusted under 35 U.S.C. 154(b) by 228 days.

(21) Appl. No.: 17/991,834

(22) Filed: Nov. 21, 2022

(65) Prior Publication Data

US 2023/0257936 A1 Aug. 17, 2023

(30) Foreign Application Priority Data

Feb. 17, 2022 (CN) ..... 202210145582.7

(51) Int. Cl.

| | |
|---|---|
| ***D21C 1/06*** | (2006.01) |
| ***D21C 1/10*** | (2006.01) |
| ***D21C 3/02*** | (2006.01) |
| ***D21H 11/08*** | (2006.01) |
| ***D21H 11/12*** | (2006.01) |

(52) U.S. Cl.

CPC ..... *D21C 1/06* (2013.01); *D21C 1/10* (2013.01); *D21C 3/02* (2013.01); *D21H 11/08* (2013.01); *D21H 11/12* (2013.01)

(58) Field of Classification Search

CPC ... D21C 1/06; D21C 1/10; D21C 3/02; D21H 11/12

See application file for complete search history.

(56) References Cited

FOREIGN PATENT DOCUMENTS

| | | | |
|---|---|---|---|
| CN | 103541264 A | * | 1/2014 |
| CN | 103789376 A | * | 5/2014 |
| CN | 112674448 A | * | 4/2021 |

OTHER PUBLICATIONS

Smook, Handbook for Pulp and Paper Technologists, 1992, Angus Wilde Publications, 2nd edition, chapters 4 and 7. (Year: 1992).*

Rydholm, Pulping Processes, 1965, Interscience Publishers, p. 677-692. (Year: 1965).*

Gao et al., Study on mechanism of kraft cooking of Dendrocalamus latiflorus Munro. 2010, Journal of Nanjing Forestry University, vol. 34. No. 2. (Year: 2010).*

Smook, Handbook for Pulp and Paper Technologists, 1992, Angus Wilde Publications, 2nd edition, chapter 9. (Year: 1992).*

English Machine translation CN103789376A, 2014. (Year: 2014).*

English Machine transation CN107373883A, 2017 (Year: 2017).*

Yang el a., Isolation and characterization of cellulosic fbers fom bamboo shoot shell, Mar. 2022, Polymer Bulletin, 80:1817-1829. (Year: 2022).*

* cited by examiner

*Primary Examiner* — Anthony Calandra

(74) *Attorney, Agent, or Firm* — Arch & Lake LLP

(57) ABSTRACT

This application provides a paper pulp, a method for producing paper pulp, and a paper pulp product. The method for producing paper pulp includes: crushing bamboo shoot shells to obtain crushed materials; mixing the crushed materials with cooking, cooking the mixture to obtain slurry; washing the slurry to obtain waste liquid and washed slurry; purifying the washed slurry to obtain the paper pulp.

10 Claims, 2 Drawing Sheets

PAPER PULP, A METHOD FOR PRODUCING PAPER PULP, AND PAPER PULP PRODUCTS

CROSS-REFERENCE TO RELATED APPLICATION

This application is based upon and claims priority to Chinese Patent Applications No. 202210145582.7, filed on Feb. 17, 2022, the entire content of which is incorporated herein by reference for all purposes.

TECHNICAL FIELD

The present disclosure relates the technical field of paper and pulp, and more particularly, a paper pulp, a method for producing paper pulp, and a paper pulp product.

BACKGROUND

Pulp is made from certain plants. It is a fundamental raw material to make paper. To date, wood is the main raw material to produce pulp. Recently, as wood resources become scarce, they can no longer meet the increasing need of the paper and pulp industry. To alleviate the insufficiency of wood resources, new raw materials for making pulp are in an urgent need.

SUMMARY

The present disclosure provides a paper pulp, a method for producing paper pulp and a paper pulp product. The method uses bamboo shoot shells as raw materials, which alleviates the insufficiency of wood resources.

In a first aspect of the present disclosure, a method for producing paper pulp is provided, and the method includes: crushing bamboo shoot shells to obtain crushed materials; mixing the crushed materials with cooking liquor to obtain a mixture, and cooking the mixture to obtain slurry; washing the slurry to obtain waste liquid and washed slurry; and purifying the washed slurry to obtain the paper pulp.

In a second aspect, the present disclosure also provides a paper pulp manufactured by the methods, including: crushing bamboo shoot shells to obtain crushed materials; mixing the crushed materials with cooking liquor to obtain a mixture, and cooking the mixture to obtain slurry; washing the slurry to obtain waste liquid and washed slurry; and purifying the washed slurry to obtain the paper pulp.

In a third aspect, the present disclosure also provides a paper pulp product as described in the second aspect of the disclosure.

It is to be understood that the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the disclosure.

DETAILED DESCRIPTION

Figure 1:
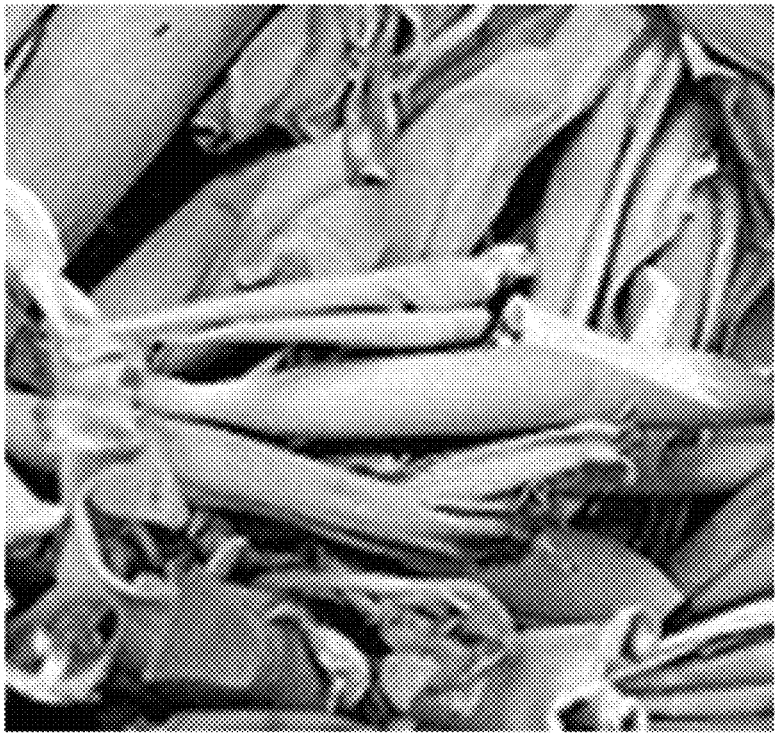
FIG. 1 illustrates the bamboo shoot shells in accordance with some examples of the present disclosure.

Reference will now be described in detail to examples, which are illustrated in the accompanying drawings. The following description refers to the accompanying drawings in which the same numbers in different drawings represent the same or similar elements unless otherwise represented. The examples described following do not represent all examples consistent with the present disclosure. Instead, they are merely examples of devices and methods consistent with aspects of the disclosure as detailed in the appended claims.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

The manufacture process of bamboo products produces a large amount of bamboo shoot shell waste. Such bamboo shoot shell waste is buried on site or simply discarded, which may cause serious environmental pollution and a waste of biomass resources.

Bamboo shoot shells exist on the nodes of stalks and main branches of bamboos and thus contain a large amount of cellulose and are of a high economic value. Effective utilization of bamboo shoot shell waste may contribute to saving resources and protecting the environment. Currently, there are a few reports about using bamboo shoot shells as potential starting materials for biomass fuels, biochemicals and biomaterials. However, the research on bamboo shoot shells is limited, and the related technologies are immature and inefficient, which renders the extraction process of dietary fibers, oligosaccharides, natural pigments and other chemicals from bamboo shoot shells too complex and prohibitively costive. Further, the processes of making adsorption purification materials and textile materials, etc., from bamboo shoot shells produce low yields and are not cost effective. All these negative factors seriously hinder the large-scale industry application of bamboo shoot shells.

In recent years, wood resources become scarce and are far from meeting the increasing needs of the pulp and paper industry. Since bamboo shoot shells contain a large amount of cellulose, they can be used as potential raw materials for producing pulp and paper. The disclosure of application uses bamboo shoot shells as raw materials. FIG. 1 is a figure of bamboo shoot shells. The present disclosure provides a method for producing pulp, comprising:

crushing bamboo shoot shells to obtain crushed materials;

mixing the crushed materials with cooking, cooking the mixture to obtain slurry;

washing the slurry to obtain waste liquid and washed slurry;

purifying the washed slurry to obtain pulp.

In the present disclosure, bamboo shoot shells are used as raw materials to manufacture pulp. As such, examples of the present disclosure may alleviate the current insufficiency of wood resources and expands the choices of raw materials for pulp manufacture. In addition, the present disclosure uses bamboo shoot shell resources more effectively and produce high-strength pulp with high yields.

In the examples of the present disclosure, the kinds of bamboo shoot shells are not limited. In some examples of the present disclosure, the bamboo shoot shells may be one or more selected from a group consisting of moso bamboo (*Phyllostachys edulis*) shoot shells, mati bamboo (*Bambusa oldhami*) shoot shells, ma bamboo (*Dendrocalamus latiflorus*) shoot shells, zao bamboo (*Phyllostachys praecox*) shoot shells, wubuji bamboo (*Phyllostachys vivax* McClure) shoot shells, baibuji bamboo (*Phyllostachys dulcis* McClure) shoot shells and jiantouqing bamboo (*Phyllostachys acuta*) shoot shells. The above-mentioned bamboo shoot shell raw materials are easy to obtain, thereby reducing the manufacture cost.

In some examples of the present disclosure, the weight of the cellulose in the bamboo shoot shells is 35% to 45% of the total weight of the bamboo shoot shells, and the weight of the lignin in the bamboo shoot shells is less than or equal to 10% of the total weight of the bamboo shoot shells. The cellulose and lignin in the bamboo shoot shells being within the above ranges may help improve the yield and strength of the pulp.

Further, in some alternative examples of the present disclosure, the weight of the cellulose in the bamboo shoot shells is 40% to 45% of the total weight of the bamboo shoot shells, and the weight of the lignin in the bamboo shoot shells is less than or equal to 5% of the total weight of the bamboo shoot shells.

In the examples of the present disclosure, crushing the bamboo shoot shells can help improve the mass transfer and heat transfer efficiency of the crushed materials during cooking.

In some examples of the present disclosure, the length of the crushed materials is less than or equal to 40 mm, and the width of the crushed materials is less than or equal to 0.5 mm;

Further, in some alternative examples of the present disclosure, the length of the crushed materials is less than or equal to 20 mm, and the width of the crushed materials is less than or equal to 0.25 mm.

In the examples of the present disclosure, the crushed materials of bamboo shoot shells are mixed with cooking to remove non-cellulose components, so as to improve the yield and strength of pulp. In some examples of the present disclosure, the cooking liquor includes an alkaline solution, and the weight of the alkaline solution is 8% to 23% of the total weight of the bamboo shoot shells. When the alkaline solution is within the above range, it can help the degradation of bamboo shoot shells and remove lignin, thereby further improving the yield and strength of pulp.

In some alternative examples of the present disclosure, the weight of the alkaline solution is 8% to 13% of the total weight of the bamboo shoot shells.

In the above examples, the composition of the alkaline solution is not limited. The alkaline solution may be a cooking liquor commonly known to those skilled in the art, such as sodium hydroxide (NaOH).

In some examples of the present disclosure, the cooking liquor further includes sodium sulfide. Sodium sulfide may protect the cellulose in the bamboo shoot shells from being corroded, thereby helping to improve the yield of pulp. The weight of sodium sulfide is 15% to 30% of the total weight of the above alkaline solution.

In some alternative examples of the present disclosure, the weight of sodium sulfide is 20% to 30% of the total weight of the alkaline solution.

In some examples of the present disclosure, the cooking temperature is 140° C. to 160° C., and the cooking time is 60 min to 90 min.

In some examples of the present disclosure, the content of undissolved matter in the slurry obtained after cooking is lower than or equal to 2.3%, and the undissolved matter usually includes components such as agglomerated fibers. The content of undissolved matter in the pulp being within the above range may help to improve the yield of pulp.

In some examples of the present disclosure, the kappa number of the slurry after cooking ranges from 15 to 50. The kappa number of the pulp being in the above range may help to improve the strength of the pulp.

In some examples of the present disclosure, washing is performed in a countercurrent manner. Countercurrent washing may make the slurry clean, thereby further improving the yield and strength of the pulp.

Further, in some examples of the present disclosure, the residual alkali content in the washed slurry is less than or equal to 150 mg/L.

Further, in some examples of the present disclosure, the Baume degree of the waste liquid is greater than or equal to 8° Bé; the free alkali content in the waste liquid is greater than or equal to 5 g/L; and the fiber content in the waste liquid is less than or equal to 0.01 g/L.

In the examples of the present disclosure, the washed slurry needs to be purified to remove impurities with large particle sizes, undissolved matters, sediment, and dust. Specifically, the impurities with large particle sizes are removed by a filter net or a cutter; the undissolved matters are removed by a pressure screen; and the sediment and dust are removed by a desander.

In a second aspect, the present disclosure also provides a pulp manufactured by the methods in any of the above examples.

In the present disclosure, the pulp is manufactured by the methods described above. Therefore, the raw materials for manufacturing the pulp are easy to obtain and the pulp are produced with a high yield and of a high strength, which can meet the increasing need of the pulp and paper industry.

In a third aspect, the present disclosure also provides a product made from the pulp described in the examples above.

In some alternative examples of the present disclosure, the product may be a paper product or a pulp molded product.

The manufacturing method of the pulp of the present disclosure will be described in detail below by examples.

Example 1

Figure 2:
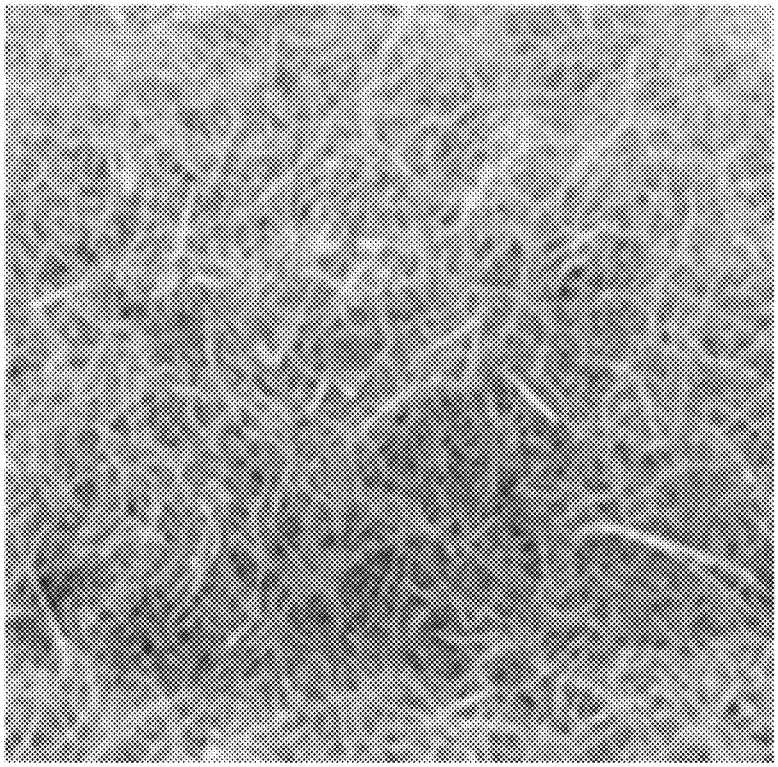
FIG. 2 illustrates the crushed bamboo shoot shells in accordance with some examples of the present disclosure.
Figure 3:
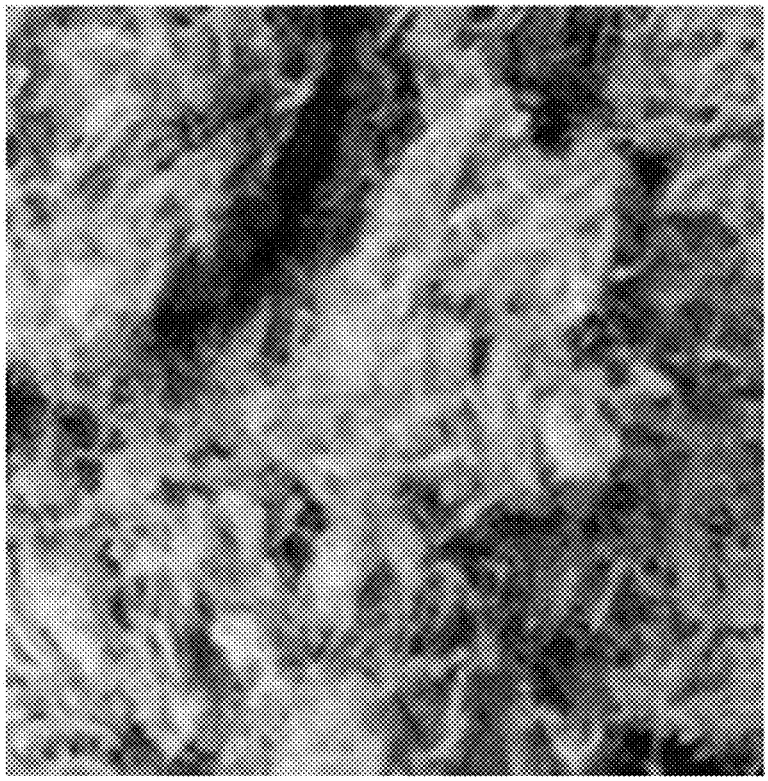
FIG. 3 illustrates the paper pulp in accordance with some examples of the present disclosure.

This example provides a method for producing pulp, comprising the following steps:

1) Crushing 100 g bamboo shoot shells to obtain crushed materials, as shown in FIG. 2, wherein the length of the crushed materials is less than or equal to 20 mm, and the width is less than or equal to 0.25 mm;
2) Introducing the crushed materials into the vertical cooking pot, mixing it with a cooking liquor, and cooking the mixture to obtain a slurry, as shown in FIG. 3, wherein the volume ratio of the bamboo shoot shells to the cooking liquor is 1:2.5, the weight of NaOH solution is 8% of the total weight of the bamboo shoot shells, the weight of $Na_2S$ solution is 15% of the total weight of NaOH solution, the cooking temperature is 160° C. and the cooking time is 60 min;
3) Washing the slurry in countercurrent to obtain waste liquid and washed slurry, wherein the residual alkali in the washed slurry is less than or equal to 150 mg/L;
4) Purifying the washed slurry to obtain pulp with a yield rate of 46.03%.

Example 2

This example provides a method for producing pulp, comprising the following steps:

1) Crushing 100 g bamboo shoot shells to obtain crushed materials, wherein the length of the crushed materials is less than or equal to 20 mm, and the width is less than or equal to 0.25 mm;
2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 8% of the total weight of the bamboo shoot shells, the weight of $Na_2S$ solution is 20% of the total weight of NaOH solution, the cooking temperature is 160° C. and the cooking time is 60 min;
3) Washing the slurry in countercurrent to obtain waste liquid and washed slurry, wherein the residual alkali in the washed slurry is less than or equal to 150 mg/L;
4) Purifying the washed slurry to obtain pulp with a yield rate of 48.17%.

Example 3

This example provides a method for producing pulp, comprising the following steps:

1) Crushing 100 g bamboo shoot shells to obtain crushed materials, wherein the length of the crushed materials is less than or equal to 20 mm, and the width is less than or equal to 0.25 mm;
2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 8% of the total weight of the bamboo shoot shells, the weight of $Na_2S$ solution is 30% of the total weight of NaOH solution, the cooking temperature is 160° C. and the cooking time is 60 min;
3) Washing the slurry in countercurrent to obtain waste liquid and washed slurry, wherein the residual alkali in the washed slurry is less than or equal to 150 mg/L;
4) Purifying the washed slurry to obtain pulp with a yield rate of 52.44%.

Example 4

This example provides a method for producing pulp, comprising the following steps:

1) Crushing 100 g bamboo shoot shells to obtain crushed materials, wherein the length of the crushed materials is less than or equal to 20 mm, and the width is less than or equal to 0.25 mm;
2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 13% of the total weight of the bamboo shoot shells, the weight of $Na_2S$ solution is 15% of the total weight of NaOH solution, the cooking temperature is 160° C. and the cooking time is 60 min;
3) Washing the slurry in countercurrent to obtain waste liquid and washed slurry, wherein the residual alkali in the washed slurry is less than or equal to 150 mg/L;
4) Purifying the washed slurry to obtain pulp with a yield rate of 42.95%.

Example 5

This example provides a method for producing pulp, comprising the following steps:

1) Crushing 100 g bamboo shoot shells to obtain crushed materials, wherein the length of the crushed materials is less than or equal to 20 mm, and the width is less than or equal to 0.25 mm;
2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 13% of the total weight of the bamboo shoot shells, the weight of $Na_2S$ solution is 20% of the total weight of NaOH solution, the cooking temperature is 160° C. and the cooking time is 60 min;
3) Washing the slurry in countercurrent to obtain waste liquid and washed slurry, wherein the residual alkali in the washed slurry is less than or equal to 150 mg/L;
4) Purifying the washed slurry to obtain pulp with a yield rate of 44.03%.

Example 6

This example provides a method for producing pulp, comprising the following steps:

1) Crushing 100 g bamboo shoot shells to obtain crushed materials, wherein the length of the crushed materials is less than or equal to 20 mm, and the width is less than or equal to 0.25 mm;
2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 13% of the total weight of the bamboo shoot shells, the weight of $Na_2S$ solution is 30% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 46.9%.

Example 7

This example provides a method for producing pulp, comprising the following steps:

1) Crushing 100 g bamboo shoot shells to obtain crushed materials, wherein the length of the crushed materials is less than or equal to 40 mm, and the width is less than or equal to 0.5 mm;

2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 18% of the total weight of the bamboo shoot shells, the weight of $Na_2S$ solution is 15% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 39.35%.

Example 8

This example provides a method for producing pulp, comprising the following steps:

1) Crushing 100 g bamboo shoot shells to obtain crushed materials, wherein the length of the crushed materials is less than or equal to 40 mm, and the width is less than or equal to 0.5 mm;

2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 18% of the total weight of the bamboo shoot shells, the weight of $Na_2S$ solution is 20% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 41.31%.

Example 9

This example provides a method for producing pulp, comprising the following steps:

1) Crushing 100 g bamboo shoot shells to obtain crushed materials, wherein the length of the crushed materials is less than or equal to 40 mm, and the width is less than or equal to 0.5 mm;

2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 18% of the total weight of the bamboo shoot shells, the weight of $Na_2S$ solution is 30% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 44.36%.

Example 10

This example provides a method for producing pulp, comprising the following steps:

1) Crushing 100 g bamboo shoot shells to obtain crushed materials, wherein the length of the crushed materials is less than or equal to 40 mm, and the width is less than or equal to 0.5 mm;

2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 23% of the total weight of the bamboo shoot shells, the weight of $Na_2S$ solution is 15% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 18.7%.

Example 11

This example provides a method for producing pulp, comprising the following steps:

1) Crushing 100 g bamboo shoot shells to obtain crushed materials, wherein the length of the crushed materials is less than or equal to 40 mm, and the width is less than or equal to 0.5 mm;

2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 23% of the total weight of the bamboo shoot shells, the weight of $Na_2S$ solution is 20% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 28.27%.

Example 12

This example provides a method for producing pulp, comprising the following steps:

1) Crushing 100 g bamboo shoot shells to obtain crushed materials, wherein the length of the crushed materials is less than or equal to 40 mm, and the width is less than or equal to 0.5 mm;

2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 23% of the total weight of the bamboo shoot shells, the weight of $Na_2S$ solution is 30% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 36.17%.

Comparative Example 1

This example provides a method for producing pulp, comprising the following steps:

1) Separating 100 g bamboo shoot shells to obtain crushed materials, wherein the length of the crushed materials is 60 mm to 180 mm, and the width is 20 mm to 60 mm, and thickness is 0.2 mm to 1 mm;

2) Introducing the crushed materials into the vertical cooking pot, mixing it with a cooking liquor, and cooking the mixture to obtain a slurry, wherein the volume ratio of the bamboo shoot shells to the cooking liquor is 1:2.5, the weight of NaOH solution is 13% of the total weight of the bamboo shoot shells, the weight of $Na_2S$ solution is 30% of the total weight of NaOH solution, the cooking temperature is 160° C. and the cooking time is 60 min;

3) Washing the slurry in countercurrent to obtain waste liquid and washed slurry, wherein the residual alkali in the washed slurry is less than or equal to 150 mg/L;

4) Purifying the washed slurry to obtain pulp with a yield rate of 10.02%.

Test Example

Figure 4:
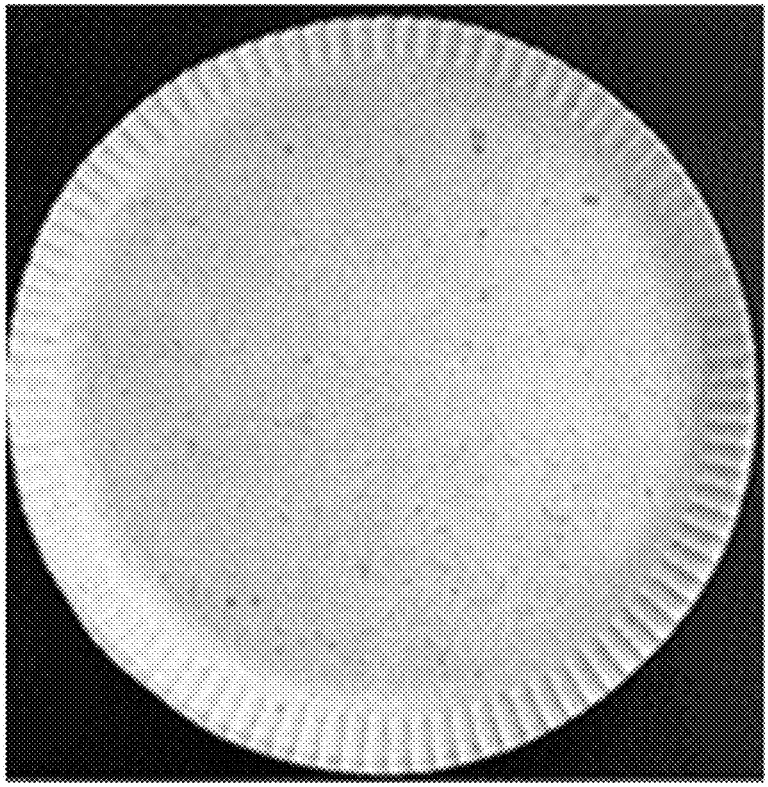
FIG. 4 illustrates the paper pulp products in accordance with some examples of the present disclosure.

Products were manufactured using the slurries prepared in Examples 1-12 and Comparative Example 1, as shown in FIG. 4, wherein the beating concentration was controlled at 4%, and the beating degree was less than or equal to 48° SR. The pulp molded products were manufactured by hot pressing and sampled with a thickness of 0.5 mm and a width of 15 mm. The bending stiffness of the samples is tested according to GB/T22364-2008. The value of the bending stiffness represents the strength of the pulp. The larger the numerical value of the bending stiffness, the higher the strength of the pulp. In addition, the yield of pulp refers to the mass of pulp obtained after pulping a unit mass of fiber raw material, expressed in percentage. The test results are shown in Table 1.

TABLE 1

| Example | NaOH (%) | $Na_2S$ (%) | Yield Rate (%) | Bending Stiffness (mN · m) |
|---|---|---|---|---|
| Example 1 | 8 | 15 | 46.03 | 13.78 |
| Example 2 | 8 | 20 | 48.17 | 13.21 |
| Example 3 | 8 | 30 | 52.44 | 14.87 |
| Example 4 | 13 | 15 | 42.95 | 14.72 |
| Example 5 | 13 | 20 | 44.03 | 14.65 |
| Example 6 | 13 | 30 | 46.90 | 15.99 |
| Example 7 | 18 | 15 | 39.35 | 9.20 |
| Example 8 | 18 | 20 | 41.31 | 9.78 |
| Example 9 | 18 | 30 | 44.36 | 10.45 |
| Example 10 | 23 | 15 | 18.70 | 8.64 |
| Example 11 | 23 | 20 | 28.27 | 8.92 |

TABLE 1-continued

| Example | NaOH (%) | $Na_2S$ (%) | Yield Rate (%) | Bending Stiffness (mN · m) |
|---|---|---|---|---|
| Example 12 | 23 | 30 | 36.17 | 9.68 |
| Comparative Example 1 | 13 | 30 | 10.02 | 6.47 |

As shown in Table 1, the differences between the test results of Example 6 and Comparative Example 1 show that crushing bamboo shoot shells may significantly improve the yield and strength of pulp.

Further, according to the test results of Examples 1-12, an appropriate ratio among the components of the cooking liquor may help improve the yield and strength of pulp. Of note, when producing pulp with wood as raw materials under regular conditions, the delignification process is quite slow if the amount of alkali used therein is lower than 17%. In contrast, the present disclosure uses bamboo shoot shells as raw materials. Bamboo shoot shells may be crushed easily. After crushing, the pulping process is relatively quick even when the amount of alkali used therein is as low as 8%, and in the meantime, the yield rate and strength of the resulting pulp are high.

In a first aspect, the present disclosure provides a method for producing pulp, comprising:

crushing bamboo shoot shells to obtain crushed materials;

mixing the crushed materials with cooking, cooking the mixture to obtain slurry;

washing the slurry to obtain waste liquid and washed slurry;

purifying the washed slurry to obtain pulp.

In the present disclosure, bamboo shoot shells are used as raw materials to manufacture pulp. As such, examples in the present disclosure may alleviate the current insufficiency of wood resources and expands the choices of raw materials for pulp manufacture. In addition, bamboo shoot shells are rich with cellulose. By the method above, bamboo shoot shell resources can be utilized efficiently to produce high-strength pulp with a high yield.

In some examples of the present disclosure, the bamboo shoot shells may be one or more selected from a group consisting of moso bamboo (*Phyllostachys edulis*) shoot shells, mati bamboo (*Bambusa oldhami*) shoot shells, ma bamboo (*Dendrocalamus latiflorus*) shoot shells, zao bamboo (*Phyllostachys praecox*) shoot shells, wubuji bamboo (*Phyllostachys vivax* McClure) shoot shells, baibuji bamboo (*Phyllostachys dulcis* McClure) shoot shells and jiantouqing bamboo (*Phyllostachys acuta*) shoot shells.

In some examples of the present disclosure, the weight of the cellulose in the bamboo shoot shells is 35% to 45% of the total weight of the bamboo shoot shells, and the weight of the lignin in the bamboo shoot shells is less than or equal to 10% of the total weight of the bamboo shoot shells.

Alternatively, the weight of the cellulose in the bamboo shoot shells is 40% to 45% of the total weight of the bamboo shoot shells, and the weight of the lignin in the bamboo shoot shells is less than or equal to 5% of the total weight of the bamboo shoot shells.

In some examples of the present disclosure, the length of the crushed materials is less than or equal to 40 mm, and the width of the crushed materials is less than or equal to 0.5 mm.

Alternatively, the length of the crushed materials is less than or equal to 20 mm, and the width of the crushed materials is less than or equal to 0.25 mm.

In some examples of the present disclosure, the cooking liquor includes an alkaline solution, and the weight of the alkaline solution is 8% to 23% of the total weight of the bamboo shoot shells.

Alternatively, the weight of the alkaline solution is 8% to 13% of the total weight of the bamboo shoot shells.

In some examples of the present disclosure, the cooking liquor further includes sodium sulfide. The weight of sodium sulfide is 15% to 30% of the total weight of the above alkaline solution.

Alternatively, the weight of sodium sulfide is 20% to 30% of the total weight of the alkaline solution.

In some examples of the present disclosure, the cooking temperature is 140° C. to 160° C., and the cooking time is 60 min to 90 min.

In some examples of the present disclosure, the washing in performed in a countercurrent manner.

In some examples of the present disclosure, the residual alkali content in the washed slurry is less than or equal to 150 mg/L.

In some examples of the present disclosure, the content of undissolved matter in the slurry obtained after cooking is lower than or equal to 2.3%.

In some examples of the present disclosure, the kappa number of the slurry after cooking ranges from 15 to 50.

In some examples of the present disclosure, the Baume degree of the waste liquid is greater than or equal to 8° Bé; the free alkali content in the waste liquid is greater than or equal to 5 g/L; and the cellulose content in the waste liquid is less than or equal to 0.01 g/L.

In a second aspect, the present disclosure also provides pulp manufactured by the methods described in any of the above examples.

In the present disclosure, the pulp is manufactured by the methods described above. Therefore, the raw materials for manufacturing the pulp are easy to obtain and the pulp are produced with a high yield and of a high strength, which can meet the increasing need of the pulp and paper industry.

In a third aspect, the present disclosure also provides a product made from the pulp described in the examples above; optionally, the product may be a paper product or a pulp molded product.

Other examples of the present disclosure will be apparent to those skilled in the art from consideration of the specification and practice of the present disclosed. This disclosure is intended to cover any variations, uses, or adaptations of the disclosure such departures from the present disclosure as come within known or customary practice in the art. It is intended that the specification and examples be considered as exemplary only, with a true scope and spirit of the present disclosure being indicated by the following claims.

It will be appreciated that that the present disclosure is not limited to the exact construction that has been described above and illustrated in the accompanying drawings, and that various modifications and changes may be made without departing from the scope thereof. It is intended that the scope of the present disclosure only by the appended claims.

What is claimed is:

1. A method for producing paper pulp, comprising:

crushing bamboo shoot shells to obtain crushed materials, wherein crushing the bamboo shoot shells improves mass transfer and heat transfer efficiency during cooking, wherein a length of the crushed materials is less than or equal to 40 mm, and in a width less than or equal to 0.5 mm;

mixing the crushed materials with a cooking liquor to obtain a mixture, wherein a volume ratio of the bamboo shoot shells to the cooking liquor is 1:2.5;

cooking the mixture to obtain a slurry at a temperature of 160° C. for 60 minutes;

washing the slurry to obtain a waste liquid and a washed slurry, wherein active alkali in the washed slurry is less than or equal to 150 mg/L, expressed as sodium oxide ($Na_2O$); and purifying the washed slurry to obtain the paper pulp.

2. The method of claim 1, wherein crushing the bamboo shoot shells to obtain the crushed materials further comprises:

crushing the bamboo shoot shells comprising one or more bamboo shoot shells selected from a group consisting of moso bamboo (*Phyllostachys edulis*) shoot shells, mati bamboo (*Bambusa oldhami*) shoot shells, ma bamboo (*Dendrocalamus latiflorus*) shoot shells, zao bamboo (*Phyllostachys praecox*) shoot shells, wubuji bamboo (*Phyllostachys vivax* McClure) shoot shells, baibuji bamboo (*Phyllostachys dulcis* McClure) shoot shells and jiantouqing bamboo (*Phyllostachys acuta*) shoot shells.

3. The method of claim 1, wherein crushing the bamboo shoot shells to obtain the crushed materials further comprises:

crushing the bamboo shoot shells comprising cellulose and lignin, wherein a weight of the cellulose is 35%-45% of a solid weight of the bamboo shoot shells, and a weight of lignin is less than or equal to 10% of the solid weight of the bamboo shoot shells.

4. The method of claim 3, wherein a weight of the cellulose is 40%-45% of the solid weight of the bamboo shoot shells, and a weight of lignin is less than or equal to 5% of the solid weight of the bamboo shoot shells.

5. The method of claim 1, wherein the length of the crushed materials is less than or equal to 20 mm, and the width of the crushed materials is less than or equal to 0.25 mm.

6. The method of claim 1, wherein mixing the crushed materials with the cooking liquor to obtain the mixture further comprises:

mixing the crushed materials with the cooking liquor comprising an active alkaline solution, wherein the active alkaline solution comprises one or more of sodium hydroxide (NaOH) and sodium sulfide ($Na_2S$), wherein a total weight of the active alkaline solution is 8% to 23% of a solid weight of the bamboo shoot shells.

7. The method of claim 6, wherein the total weight of the active alkaline solution is 8% to 13% of the solid weight of the bamboo shoot shells.

8. The method of claim 6, wherein the cooking liquor further comprises sodium sulfide, and a weight of the sodium sulfide is 15% to 30% of the total weight of the active alkaline solution.

9. The method of claim 8, wherein the weight of sodium sulfide is 20% to 30% of the total weight of the active alkaline solution.

10. The method of claim 1, wherein undissolved matters, comprising screen rejects removed by a pressure screen from the slurry, are less than or equal to 2.3%, and a kappa number of the slurry is 15 to 50.

* * * * *